US012571388B2

(12) United States Patent
Xu et al.

(10) Patent No.: US 12,571,388 B2
(45) Date of Patent: Mar. 10, 2026

(54) CLEANING SYSTEM USED FOR VEHICLES AND CAPABLE OF SUPPRESSING VIBRATIONS AND REDUCING NOISE

(71) Applicant: NINGBO HENGSHUAI CO., LTD., Ningbo (CN)

(72) Inventors: Hengshuai Xu, Ningbo (CN); Cijin Feng, Ningbo (CN); Lihong Zeng, Ningbo (CN); Peihai Liu, Ningbo (CN)

(73) Assignee: NINGBO HENGSHUAI CO., LTD., Ningbo (CN)

( * ) Notice: Subject to any disclaimer, the term of this patent is extended or adjusted under 35 U.S.C. 154(b) by 0 days.

(21) Appl. No.: 18/993,567

(22) PCT Filed: Sep. 7, 2022

(86) PCT No.: PCT/CN2022/117673

§ 371 (c)(1),
(2) Date: Jan. 12, 2025

(87) PCT Pub. No.: WO2024/021240

PCT Pub. Date: Feb. 1, 2024

(65) Prior Publication Data

US 2026/0028980 A1 Jan. 29, 2026

(30) Foreign Application Priority Data

Jul. 24, 2022 (CN) ..... 202210873503.4

(51) Int. Cl.
*F04B 53/00* (2006.01)
*F04D 29/66* (2006.01)
*F04D 29/68* (2006.01)

(52) U.S. Cl.
CPC ..... *F04B 53/004* (2013.01); *F04B 53/003* (2013.01); *F04D 29/66* (2013.01); *F04D 29/668* (2013.01); *F04D 29/688* (2013.01)

(58) Field of Classification Search
CPC ..... F04B 53/004; F04B 53/003; F04D 29/66; F04D 29/668; F04D 29/688
See application file for complete search history.

(56) References Cited

U.S. PATENT DOCUMENTS

2006/0199050 A1* 9/2006 Choi ..... F04B 53/003 429/444
2018/0119686 A1* 5/2018 Shakal ..... F04B 39/127
(Continued)

FOREIGN PATENT DOCUMENTS

CN 211417211 U * 9/2020
CN 112343846 A * 2/2021 ..... F04D 25/08
(Continued)

OTHER PUBLICATIONS

Feng et al (CN 112810572)—Machine Translation (Year: 2021).*

*Primary Examiner* — Brian Christopher Delrue
(74) *Attorney, Agent, or Firm* — Addison D. Ault; IPGentleman Intellectual Property Services, LLC

(57) ABSTRACT

A cleaning system used for vehicles and capable of suppressing vibrations and reducing noise is disclosed. The cleaning system includes a cleaning liquid tank provided with an upward liquid outlet and a limiting plate opposite the liquid outlet; an engagement slot is provided in the limiting plate; a sealing hole is provided in the center of a sealing ring, and the sealing ring is fixed to the liquid outlet; a liquid intake nozzle is arranged at one end of a cleaning pump and inserted into the sealing hole of the sealing ring; an end face of the cleaning pump abuts against a surface of the sealing ring to axially position the cleaning pump; an elastic positioning sleeve is fixed to an elastic positioning member and a plurality of vibration suppression holes are provided at intervals in the elastic positioning sleeve.

10 Claims, 12 Drawing Sheets

(56) References Cited

U.S. PATENT DOCUMENTS

| | | | | |
|---|---|---|---|---|
| 2019/0293068 | A1* | 9/2019 | Date | F04B 53/003 |
| 2020/0254159 | A1* | 8/2020 | Van Asseldonk | A61M 1/064 |
| 2025/0271002 | A1* | 8/2025 | Abuhamdia | F04D 19/042 |

FOREIGN PATENT DOCUMENTS

| | | | | | |
|---|---|---|---|---|---|
| CN | 112810572 | A | * | 5/2021 | B60S 1/50 |
| CN | 214648145 | U | * | 11/2021 | |
| CN | 115402266 | A | * | 11/2022 | B60S 1/50 |
| CN | 218616579 | U | * | 3/2023 | |
| EP | 4559763 | A1 | * | 5/2025 | B60S 1/50 |
| JP | 2002303294 | A | * | 10/2002 | F04D 29/668 |

* cited by examiner

CLEANING SYSTEM USED FOR VEHICLES AND CAPABLE OF SUPPRESSING VIBRATIONS AND REDUCING NOISE

CROSS-REFERENCE TO RELATED APPLICATION

This application is a Section 371 National Stage Application of International Application No. PCT/CN2022/117673, filed on Sep. 7, 2022, entitled "CLEANING SYSTEM USED FOR VEHICLES AND CAPABLE OF SUPPRESSING VIBRATIONS AND REDUCING NOISE", which claims priority to Chinese Application No. CN202210873503.4, filed on Jul. 24, 2022, incorporated herein by reference in their entirety.

TECHNICAL FIELD

The present disclosure relates to a cleaning system used for vehicles, and in particular to a cleaning system used for vehicles and capable of suppressing vibrations and reducing noise.

BACKGROUND

With the continuous development and progress of the automobile industry, assisted driving and intelligent driving technologies have gradually begun to be applied. More and more cameras, sensors and laser radars need to be installed outside the vehicle body. Since these devices installed outside the vehicle body are exposed to the outside, small flies, dust, mud or ice and snow attached to them will affect the perception ability of these devices and reduce the accuracy of data collection. For assisted driving and automatic driving vehicles that are driven on the road, if these devices are contaminated and cannot be discovered and cleaned quickly, the collected data will be reduced in accuracy, which will affect the control of the vehicle and even endanger driving safety in serious cases.

Since the cleaning system needs to spray cleaning liquid to these devices with high pressure and large flow rate to achieve the cleaning effect, the cleaning pump needs to rotate at high speed to provide power. The vibration generated by the high-speed rotating cleaning pump will be transmitted to the cleaning liquid tank, and such vibration will be further amplified by the cleaning liquid tank to cause greater vibration and noise, directly affecting the comfort of the driver and passengers, which is unacceptable. Therefore, it is urgent to design a vehicle cleaning system that can suppress vibration and reduce noise, so as to meet the comfort requirements of the vehicle.

SUMMARY

Technical Problem

The technical problem to be solved by the present disclosure is to overcome the above-mentioned deficiencies of the prior art and provide a vibration-suppressing and noise-reducing vehicle washing system (a cleaning system used for vehicles and capable of suppressing vibrations and reducing noise), so that it can better suppress the vibration of the washing system, thereby reducing vibration and noise.

Solutions to the Problem

Technical Solutions

The technical solutions adopted by the present disclosure to solve the above-mentioned technical problem are:

A cleaning system used for vehicles and capable of suppressing vibrations and reducing noise, comprising a cleaning liquid tank, a cleaning pump, an elastic positioning sleeve and an elastic sealing ring, wherein a lower portion of the cleaning liquid tank is provided with an upward liquid outlet; a limiting plate is provided on a side surface of the cleaning liquid tank, and the limiting plate is opposite the liquid outlet; an engagement slot is provided in the limiting plate; a sealing hole is provided in the center of the sealing ring, and the sealing ring is fixed to the liquid outlet; a liquid intake nozzle is arranged at one end of the cleaning pump and inserted into the sealing hole of the sealing ring, an end face of the cleaning pump abuts against a surface of the sealing ring to axially position the cleaning pump; an elastic positioning member is arranged on a top cover of the cleaning pump; a positioning hole, which corresponds to the elastic positioning member, is provided in the center of the elastic positioning sleeve, so that the elastic positioning sleeve is fixed to the elastic positioning member; a plurality of vibration suppression holes are provided at intervals in the elastic positioning sleeve on the periphery of the positioning hole; the bottom of the elastic positioning sleeve is provided with an edge; and the elastic positioning sleeve is configured to sleeve the elastic positioning member, so as to be fixed to the elastic positioning member, and the elastic positioning sleeve engages with the engagement slot in the limiting plate, so that the edge is axially limited by the bottom surface of the limiting plate, and the outer periphery of the elastic positioning sleeve engages with an engagement portion on the engagement slot, so as to fix the cleaning pump.

According to some embodiments of the present disclosure, the engagement slot of the limiting plate comprises an engagement socket and a plurality of arc-shaped engagement portions that cooperate with the outer periphery of the elastic positioning sleeve, and the positioning sleeve is radially limited by the arc-shaped engagement portions, so as to better fix the cleaning pump.

According to some embodiments of the present disclosure, a vibration-suppressing slot is provided between two adjacent engagement portions of the limiting plate, and the periphery of the vibration-suppressing slot does not contact the outer periphery of the positioning sleeve, so that the vibration suppression and noise reduction effect of the positioning sleeve is better.

According to some embodiments of the present disclosure, avoidance slots are respectively provided on both sides of the engagement socket.

According to some embodiments of the present disclosure, an axial opening slot is provided in the clastic positioning member (elastic positioning column), so that the positioning column can be pressed at the part of the opening slot and move inward, making it radially elastic, thereby facilitating the installation of the positioning sleeve on the positioning column and the installation of the positioning sleeve into the limiting plate, and having better assemblability.

According to some embodiments of the present disclosure, the elastic positioning member (elastic positioning column) is provided with a cylindrical hole at its center, so that the wall thickness of the positioning column is uniform, and it has better molding processability, and avoids shrinkage deformation.

According to some embodiments of the present disclosure, the elastic positioning member is cylindrical, and the elastic positioning sleeve is cylindrical.

According to some embodiments of the present disclosure, a first vibration-suppressing hollow ring is arranged on the outer periphery of the sealing hole at a lower end of the elastic sealing ring. Such a sealing ring has better vibration-damping and noise-proof effects.

According to some embodiments of the present disclosure, a second vibration-suppressing hollow ring is arranged on the outer periphery of the sealing hole at a fixing surface of the elastic sealing ring, and a plurality of vibration-suppressing strips are arranged in the second vibration-suppressing hollow ring. Such a sealing ring has better vibration-damping and noise-proof effects.

According to some embodiments of the present disclosure, the elastic sealing ring is provided with an annular groove, and the annular groove is buckled into the edge of the liquid outlet for fixing, so that the fixing is firm.

According to some embodiments of the present disclosure, a round table surface is provided on the outer circle of the lower part of the sealing ring, so that the sealing ring is conveniently installed in the mounting hole of the cleaning liquid tank, having better assemblability.

Beneficial Effects of the Present Disclosure

Beneficial Effects

Compared with the prior art, the advantage of the present disclosure is that: by providing a positioning sleeve and a sealing ring of a special structure between the cleaning liquid tank and the cleaning pump, the vibration generated by the high-speed rotation of the cleaning pump during operation is damped by the positioning sleeve and the sealing ring, and the vibration transmitted to the cleaning liquid tank by the cleaning pump is weakened, thereby reducing the vibration and noise caused by the further amplification of the cleaning liquid tank, and preventing noise interference to the driver and passengers and affecting comfort.

BRIEF DESCRIPTION OF THE DRAWINGS

Description of the Drawings

Figure 1:
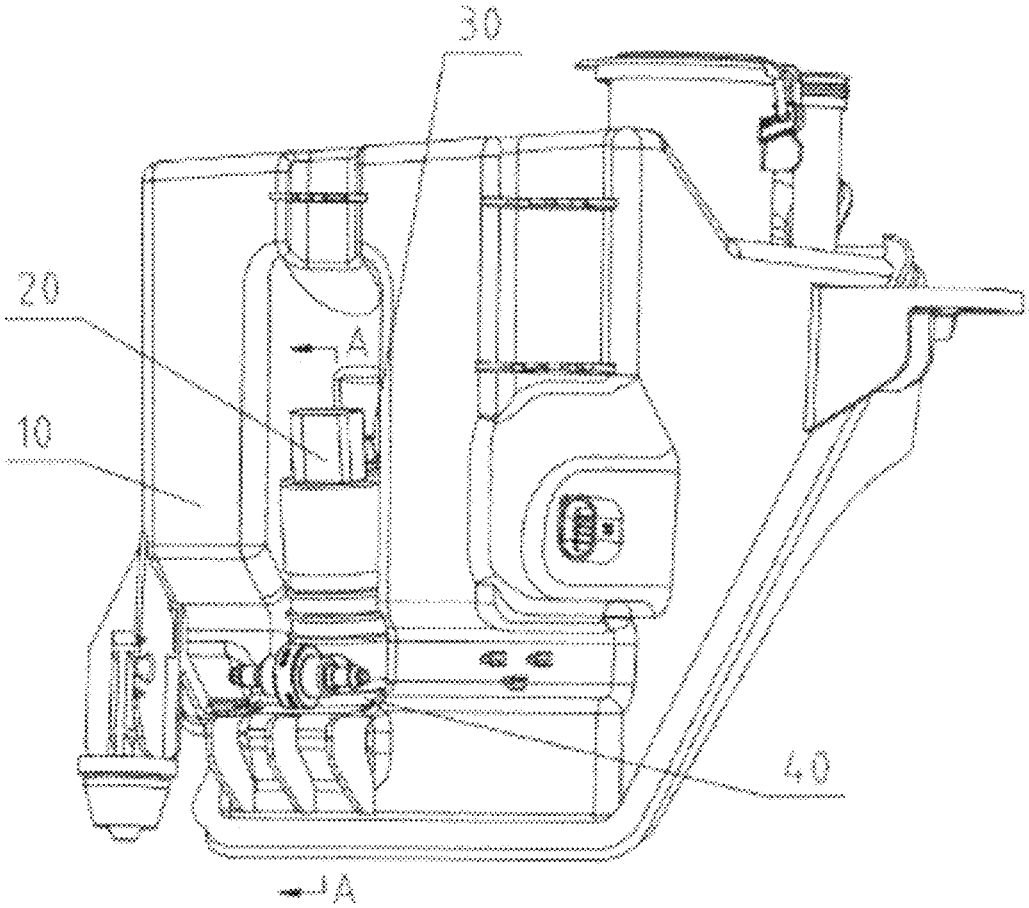

FIG. 1 is a stereoscopic view of a vibration-suppressing and noise-reducing vehicle washing system (a cleaning system used for vehicles and capable of suppressing vibrations and reducing noise) according to an embodiment of the present disclosure.

Figure 2:
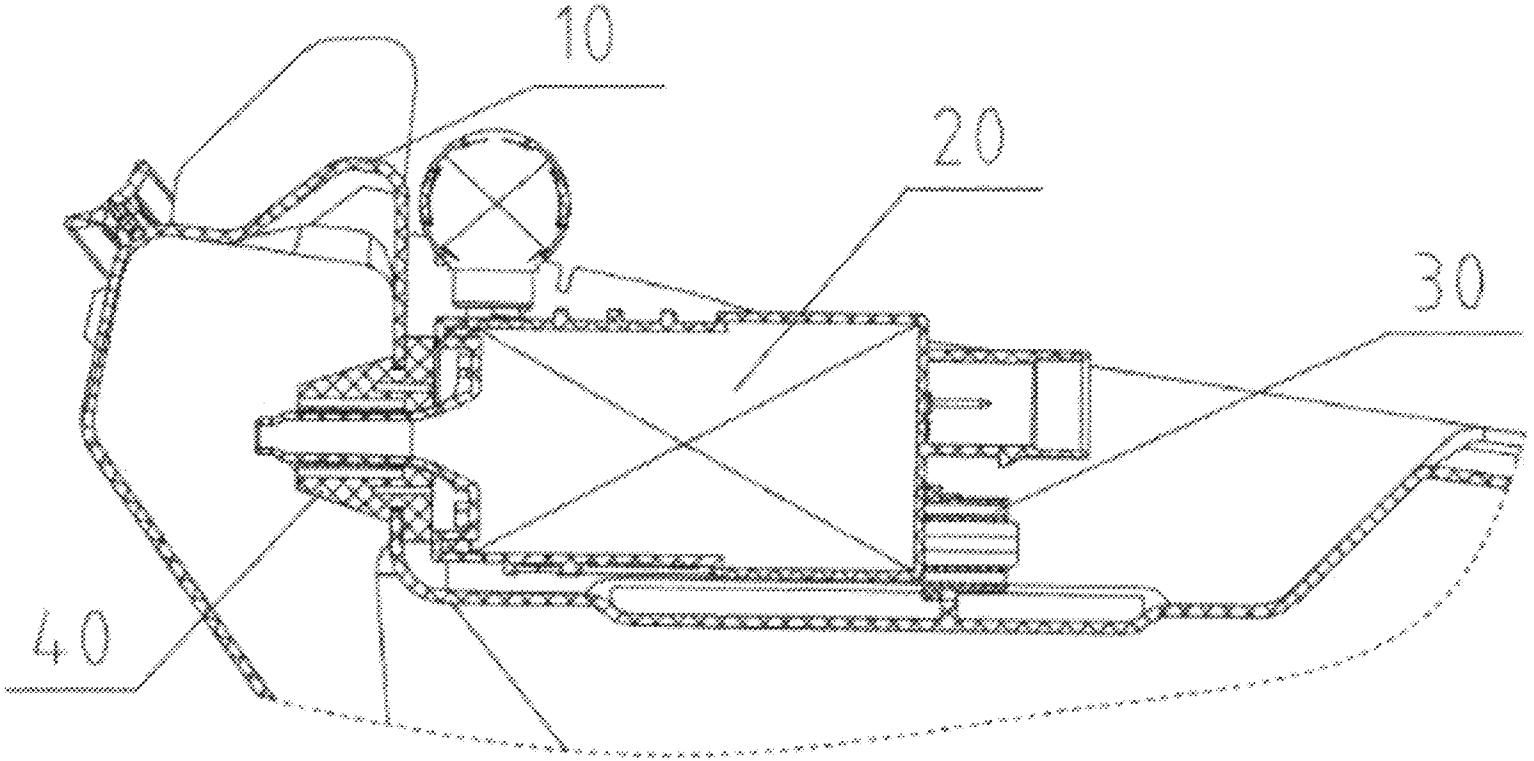

FIG. 2 is a partially enlarged cross-sectional view of FIG. 1 along A-A.

Figure 3:
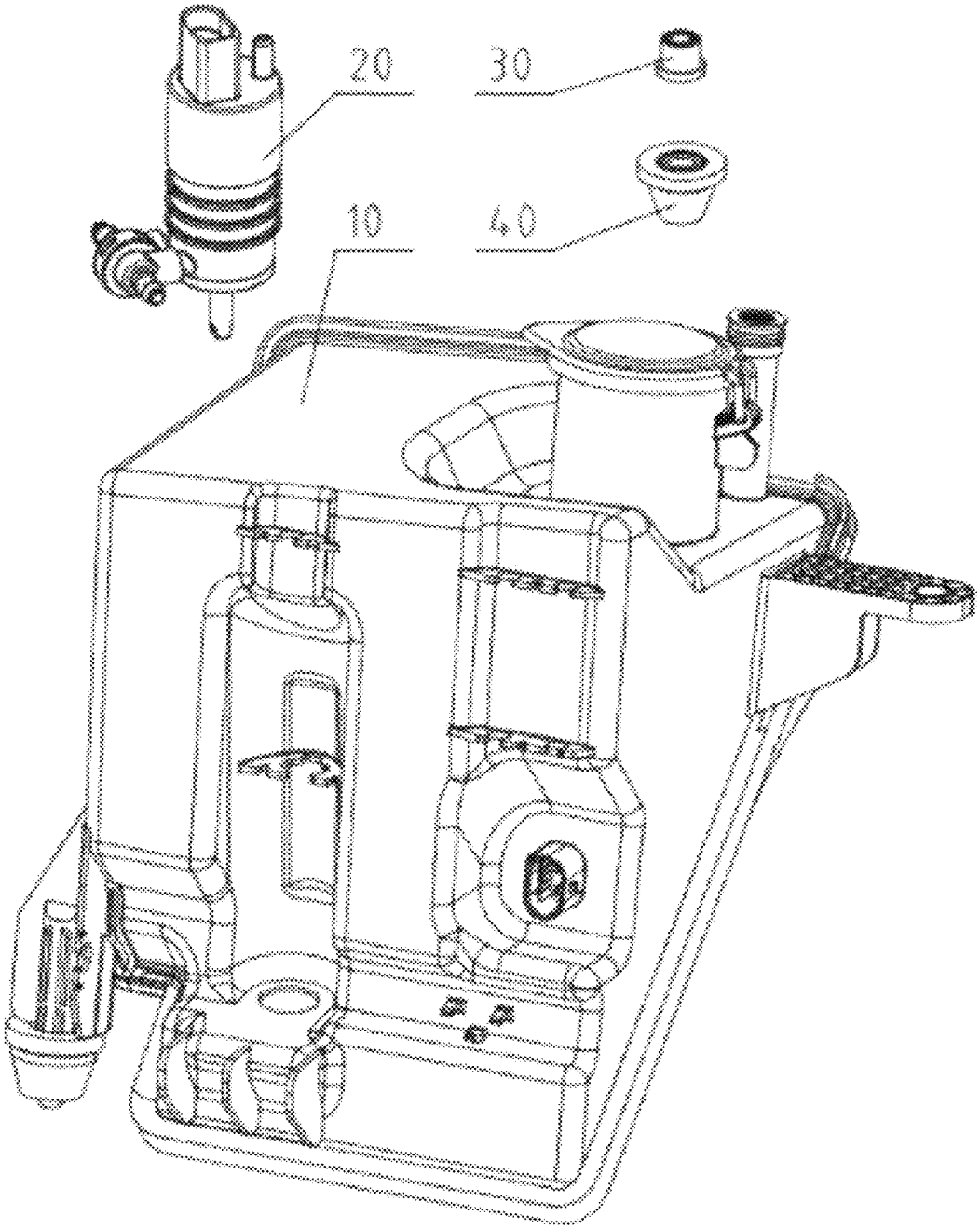

FIG. 3 is a schematic view of a decomposed vibration-suppressing and noise-reducing vehicle washing system according to an embodiment of the present disclosure.

Figure 4:
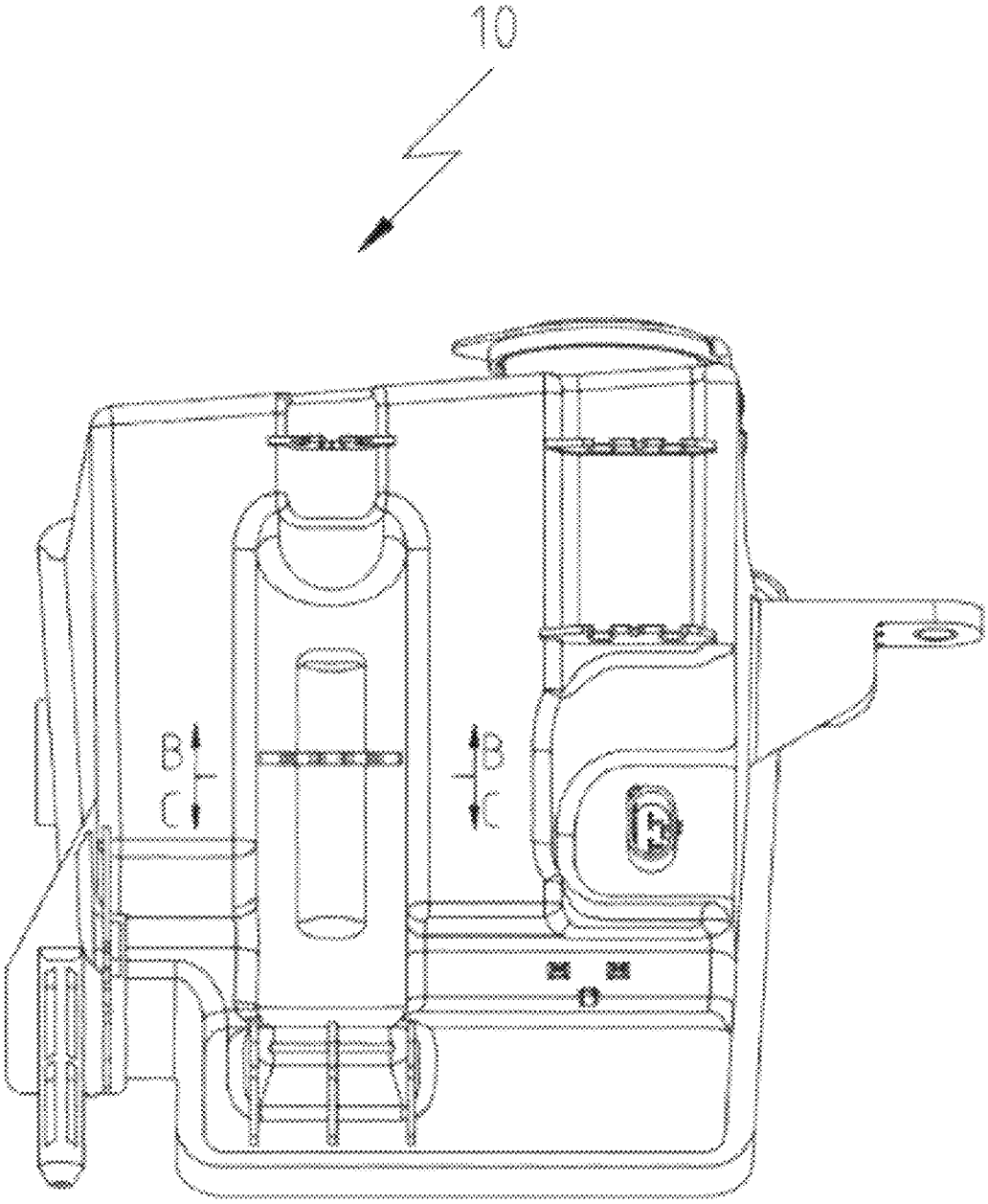

FIG. 4 is a front view of a cleaning liquid tank according to an embodiment of the present disclosure.

Figure 5:
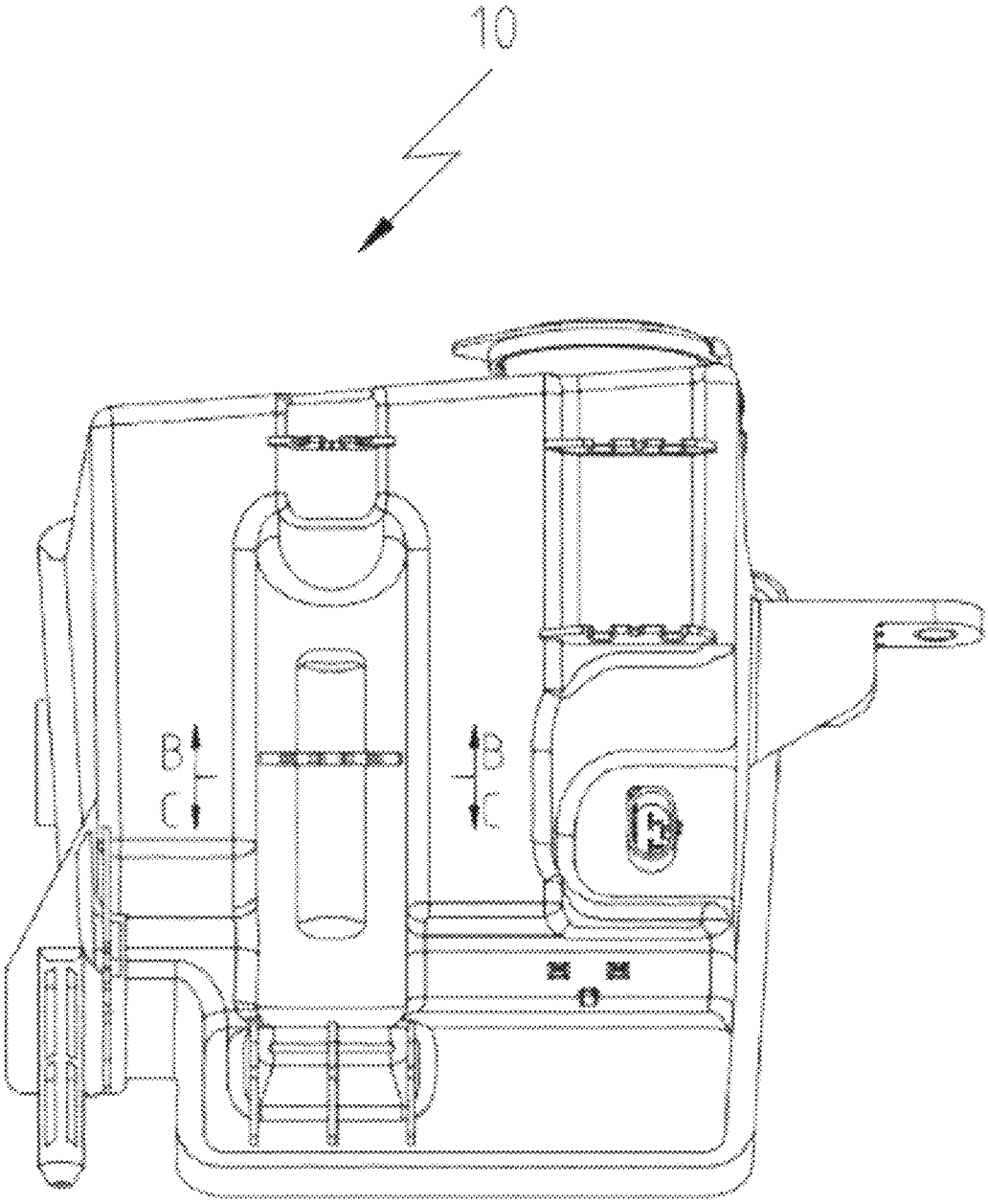

FIG. 5 is a partially enlarged cross-sectional view of FIG. 4 along B-B.

Figure 6:
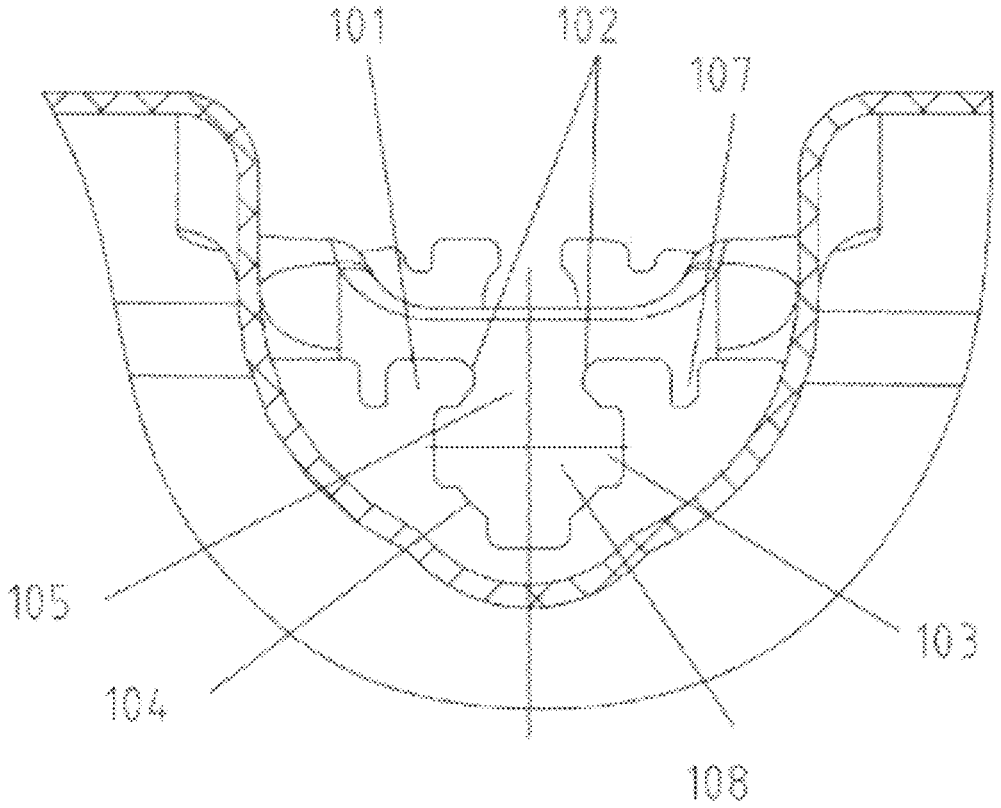

FIG. 6 is a partially enlarged cross-sectional view of FIG. 4 along C-C.

Figure 7:
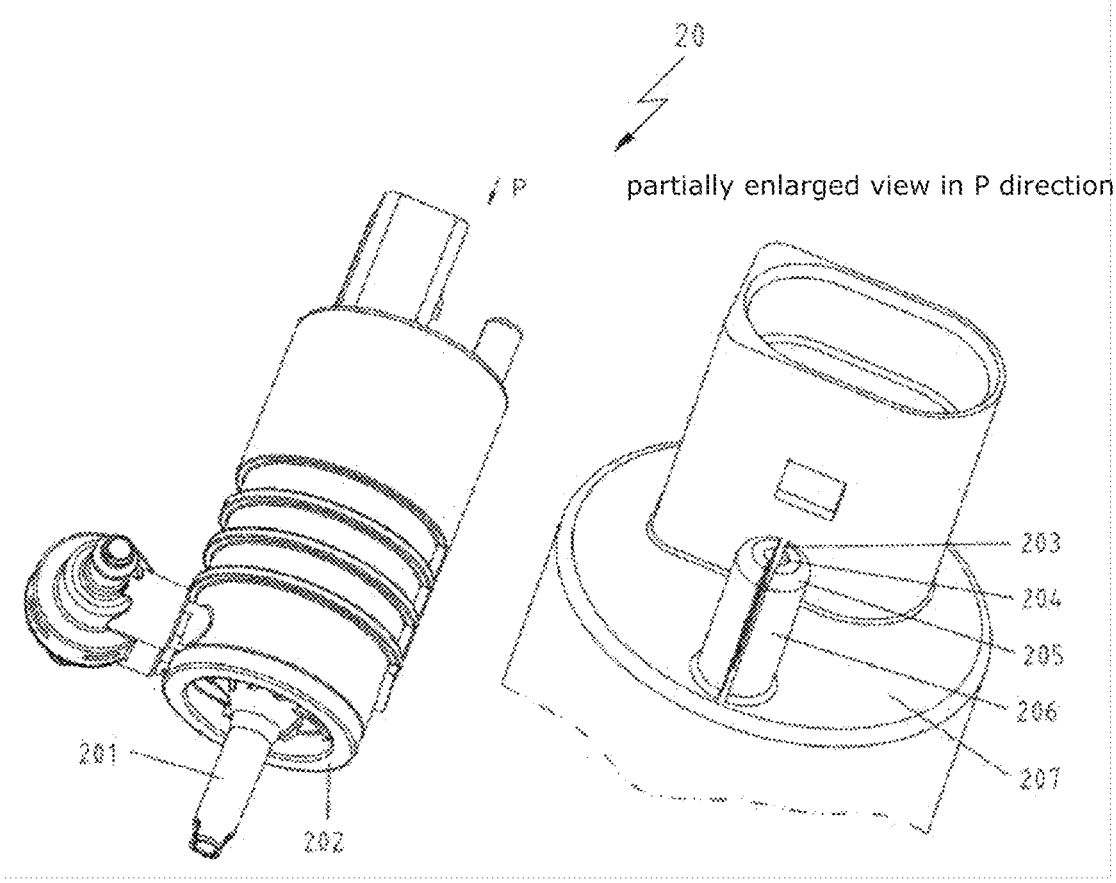

FIG. 7 is a schematic structural view of a cleaning pump according to an embodiment of the present disclosure.

Figure 8:
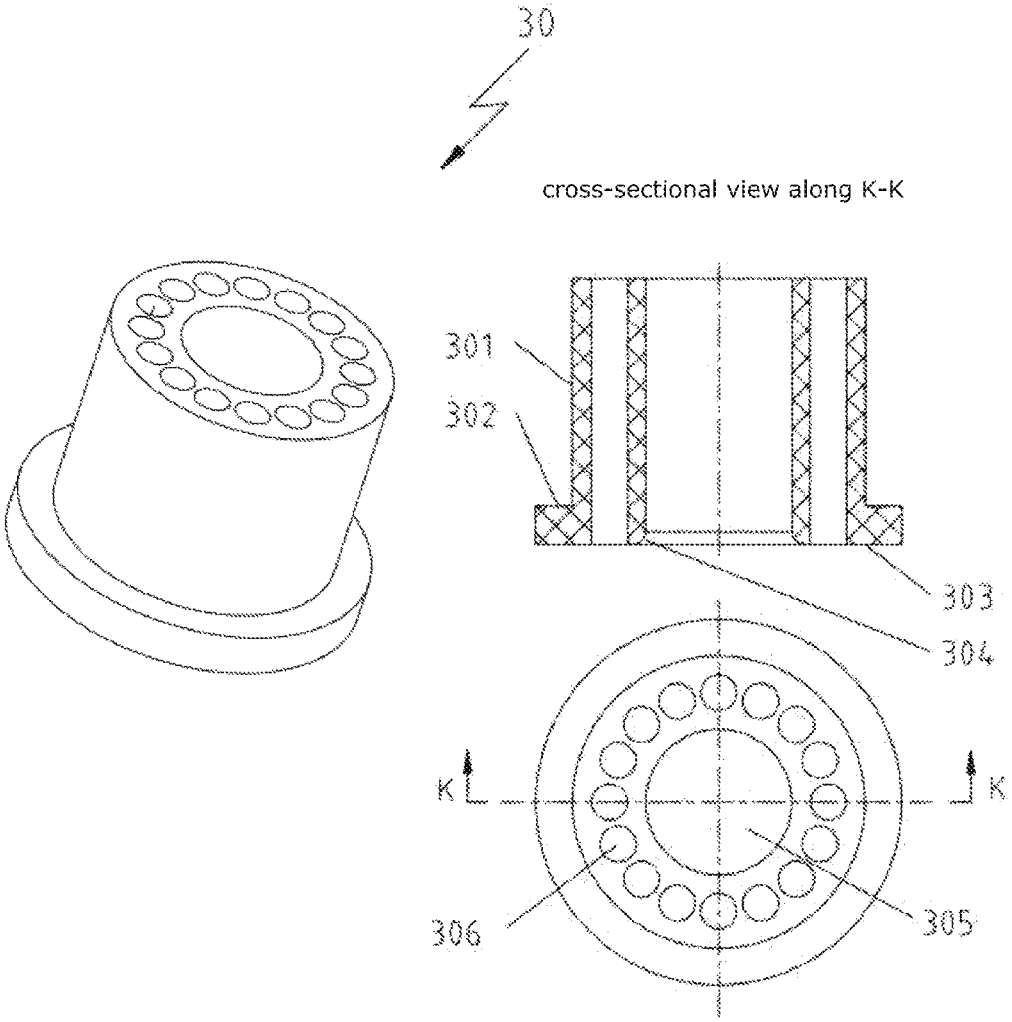

FIG. 8 is a schematic structural view of a positioning sleeve according to an embodiment of the present disclosure.

Figure 9:
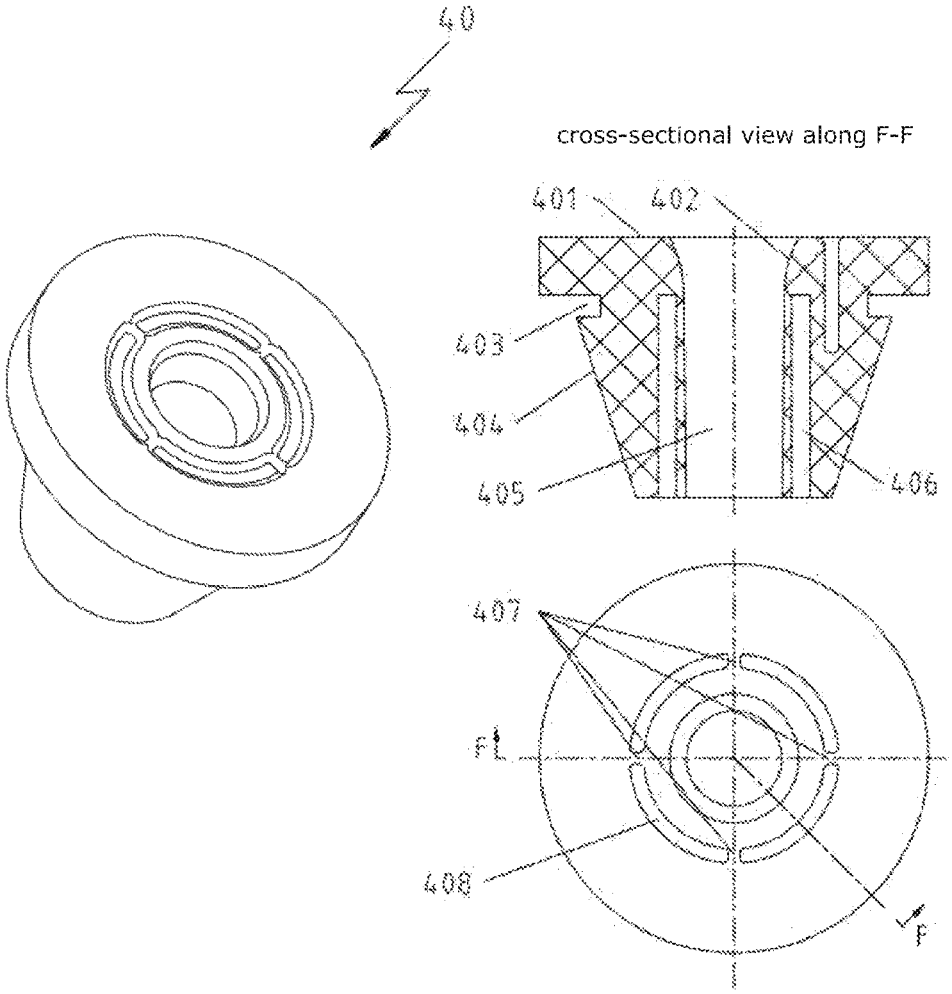

FIG. 9 is a schematic structural view of a sealing ring according to an embodiment of the present disclosure.

Figure 10:
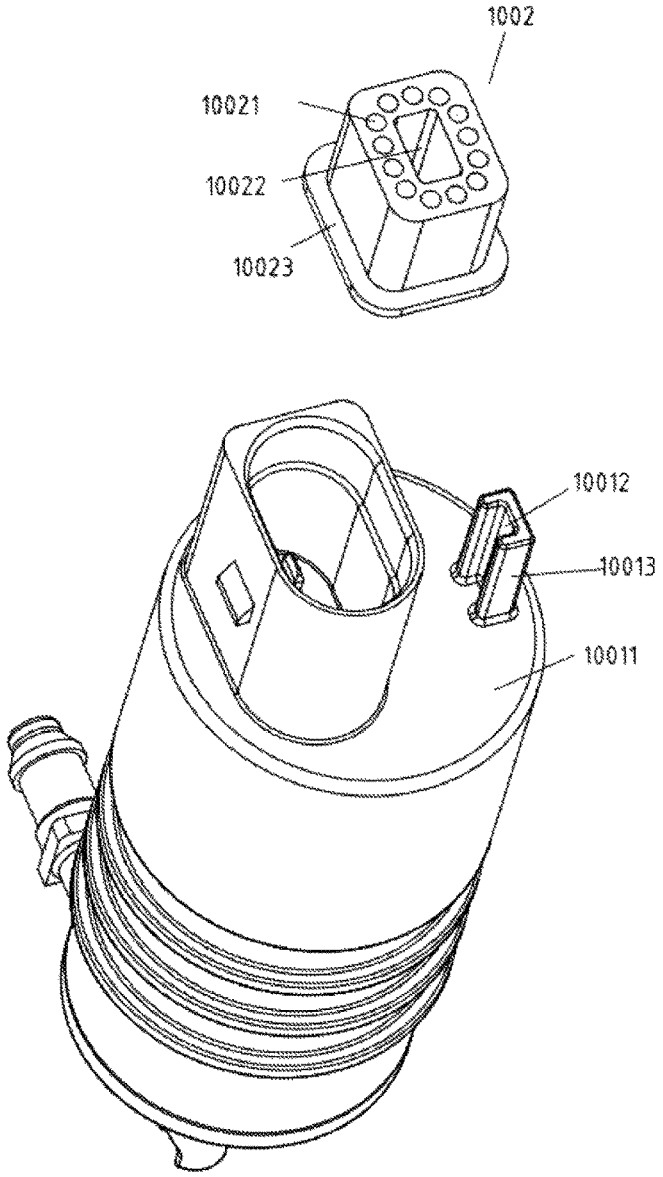

FIG. 10 is a schematic structural view of a positioning column and a positioning sleeve according to another embodiment of the present disclosure.

Figure 11:
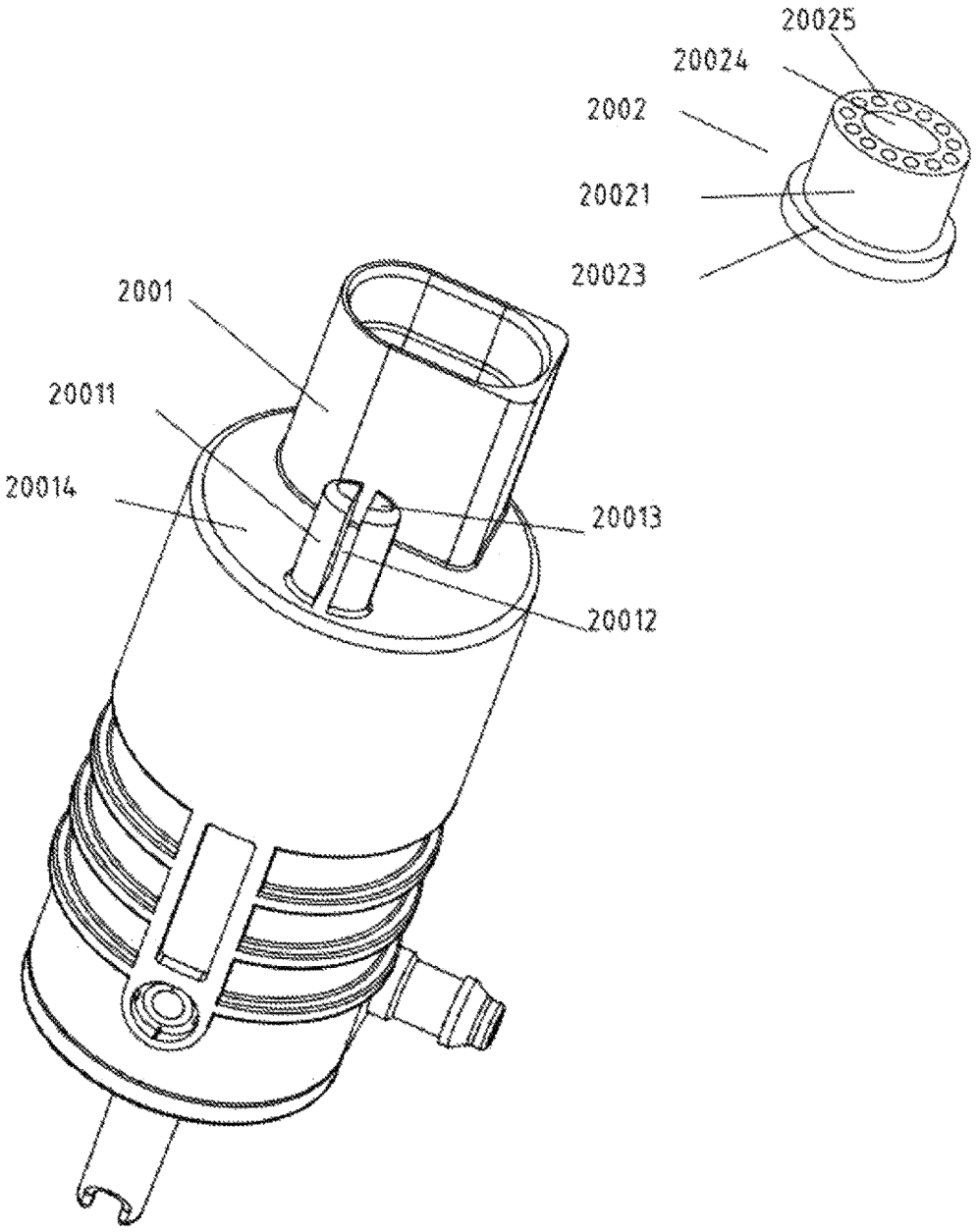

FIG. 11 is a schematic structural view of a positioning column and a positioning sleeve in another embodiment of the present disclosure.

Figure 12:
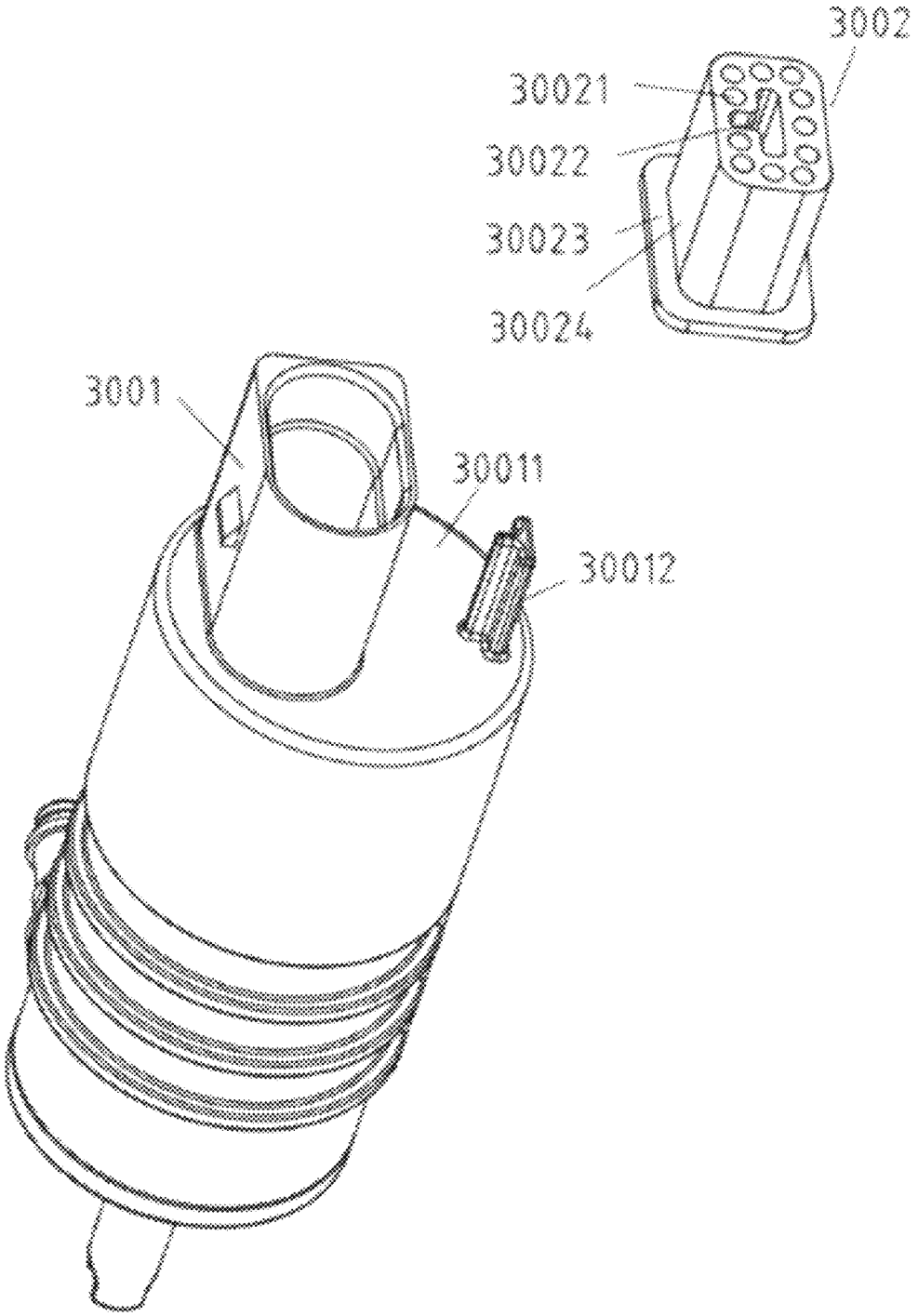

FIG. 12 is a schematic structural view of a positioning column and a positioning sleeve in a further embodiment of the present disclosure.

DETAILED DESCRIPTION OF EMBODIMENTS

Implementation Mode of the Present Disclosure

The present disclosure will be further described below in conjunction with the accompanying drawings and embodiments.

As shown in FIGS. 1-9, a vibration-suppressing and noise-reducing vehicle cleaning system (a cleaning system used for vehicles and capable of suppressing vibrations and reducing noise) comprises a cleaning liquid tank 10, a cleaning pump 20, an elastic positioning sleeve 30 and an elastic sealing ring 40.

As shown in FIGS. 4-9, an upward mounting hole 106 (liquid outlet) is provided at the lower part of the cleaning liquid tank 10, the mounting hole cooperates with the annular groove 403 of the sealing ring 40, and the annular groove 403 is buckled into the edge of the mounting hole 106 to fix the sealing ring 40 on the lower part of the cleaning liquid tank 10.

A limiting plate 101 is arranged on the side wall of the cleaning liquid tank 10. The limiting plate 101 is opposite to the mounting hole 106 (liquid outlet). An engagement slot 108 is arranged in the limiting plate 101. The engagement slot 108 includes an engagement socket 105 and a plurality of engagement portions that cooperate with the outer periphery of the positioning sleeve. In this embodiment, the arc-shaped engagement portions 104 are provided. The positioning sleeve 30 can be installed into the engagement slot 108 of the limiting plate 101 from the engagement socket 105, and the positioning sleeve 30 is radially limited by the arc-shaped engagement portions 104, and the bottom edge of the positioning sleeve 30 is pressed by the bottom surface of the limiting plate 101 to limit the axial position, so as to limit the cleaning pump 20 and prevent the cleaning pump 20 from loosening.

A vibration-suppressing slot 103 is also provided between the adjacent arc-shaped engagement portions 104, and the edge of the vibration-suppressing slot 103 does not contact the outer periphery 301 of the positioning sleeve, so that the vibration suppression and noise reduction effect of the positioning sleeve 30 can be better.

Avoidance slots 107 are respectively provided on both sides of the above-mentioned engagement socket 105, so that it is more convenient to buckle the positioning sleeve 30 through the engagement socket, and the positioning sleeve 30 is reset faster after being buckled into the engagement socket 105, and the positioning sleeve 30 can be better fixed.

A transition arc 102 is provided at the engagement socket 105 of the above-mentioned limiting plate 101, and the sleeve body 301 of the positioning sleeve 30 is easily clamped along the transition arc 102, which facilitates the assembly of the positioning sleeve 30 into the limiting plate 101 and improves the assemblability.

The cleaning pump 20 is provided with a positioning column 206 on the upper end cover 207. In this embodiment, the positioning column 206 is a cylinder, which cooperates with the positioning hole 305 of the positioning sleeve 30. The positioning sleeve 30 is configured to sleeve the positioning column and fixed on the positioning column 206 through the positioning hole 305.

The positioning column 206 is also provided with an opening slot/groove 203 in a vertical direction, so that the positioning column 206 has elasticity in the radial direction, which is convenient for the positioning sleeve 30 to be installed on the positioning column 206, and also convenient for the positioning sleeve 30 to be installed in the limiting plate 101. In this way, the assembly performance is better.

The positioning column 206 is provided with a cylindrical hole 204 at its center, so that the wall thickness of the positioning column 206 is uniform, has better molding processability, and avoids shrinkage deformation.

The positioning column 206 is provided with a transition arc surface 205 at its end, which is convenient for the positioning sleeve 30 to be installed along the transition arc surface 205.

The positioning sleeve 30 is made of elastic material. In this embodiment, the main body of the positioning sleeve 30 is a cylinder, and a cylindrical positioning hole 305 is arranged at the center thereof to cooperate with the positioning column 206. A plurality of vibration-suppressing holes 306 are evenly arranged at intervals along the circumference of the body of the positioning sleeve between the circumference of the cylindrical positioning hole 305 and the outer cylindrical surface 301, and an annular edge 307 is arranged at the bottom of the positioning sleeve 30.

A transition arc surface 304 is arranged at the mouth of the positioning hole 305 to facilitate the insertion of the positioning sleeve 30 on the positioning column 206.

When the positioning sleeve 30 is buckled into the engagement slot of the limiting member, the outer cylindrical surface 301 is clamped by the plurality of arc-shaped engagement portions 104, the mounting surface 303 of the edge 307 is attached to the end cover surface 207 of the cleaning pump 20, and the positioning surface 302 is limited by the bottom surface of the limiting plate 101, thereby fixing and limiting the cleaning pump 20.

The sealing ring 40 is made of elastic material, and its upper end surface 401 is set as a fixing surface to axially position the bottom surface 202 of the pump cover that is set at the side of the liquid intake nozzle 201 on the cleaning pump 20.

The sealing ring 40 is provided with a sealing hole 405 in the center to seal the liquid intake nozzle 201 set in the cleaning pump 20 and fix the liquid intake nozzle 201.

The sealing ring 40 is provided with a second vibration-suppressing hollow ring 408 on the outer periphery of the sealing hole 405 at a fixing surface 401 of the sealing ring, and a plurality of vibration-suppressing strips 407 are provided in the second vibration-suppressing hollow ring 408 to separate the second hollow ring 408 into multiple sections, and a first vibration-suppressing hollow ring 406 is provided on the outer periphery of the sealing hole 405 at the lower end thereof to achieve the effect of vibration damping and noise reduction.

The sealing hole 405 of the sealing ring 40 is provided with a transition arc surface 402, which facilitates the insertion of the liquid intake nozzle 201 of the cleaning pump 20 into the sealing hole 405, thereby improving the assemblability.

The lower outer circle of the sealing ring 40 is provided with a round table surface 404, which facilitates the installation of the sealing ring 40 into the mounting hole 106 of the cleaning liquid tank 10, so as to improve the assemblability.

The above-mentioned vehicle cleaning system can be conveniently installed in the following order: first install the sealing ring 40 on the mounting hole 106 of the cleaning liquid tank 10, install the positioning sleeve 30 on the positioning column 206 of the cleaning pump 20, and then insert the liquid intake nozzle 201 of the cleaning pump 20 into the sealing hole 405 of the sealing ring 40, and then clamp the positioning sleeve 30 into the engagement slot of the limiting plate 101 of the cleaning liquid tank 10 to fix the cleaning pump 20.

As shown in FIG. 10, a positioning member and a positioning sleeve of another embodiment are shown. The positioning sleeve 1002 is a quadrilateral, and a quadrilateral hole 10022 is arranged inside it. Spaced vibration-suppressing holes 10021 are arranged outside the quadrilateral hole 10022, and a quadrilateral edge 10023 is arranged on the bottom edge. A quadrilateral column 10013 is arranged on the top surface of the cleaning pump 10011 to install the positioning sleeve 1002. The quadrilateral column 10013 is consistent with the quadrilateral hole 10022. The positioning sleeve 1002 can be fixed on the positioning column 10013. Moreover, a groove/slot 20012 is arranged in the quadrilateral of the positioning column 10013 of this embodiment, so that it is more convenient to install the positioning sleeve 1002.

Similarly, an engagement slot (not shown) matching the positioning sleeve 1002 can be provided in the limiting plate of the cleaning liquid tank, so that the outer periphery of the positioning sleeve 1002 is limited by the engagement slot, and the quadrilateral edge 10023 is limited by the bottom surface of the limiting plate, thereby fixing and limiting the cleaning pump 20. In this way, the vibration suppression and noise reduction effect can also be achieved.

As shown in FIG. 11, it shows a positioning member and a positioning sleeve of another embodiment, the positioning sleeve 2002 is an elliptical cylinder, an elliptical cylinder hole 20024 is provided inside it, and spaced vibration-suppressing holes 20025 are provided outside the elliptical cylinder hole 20024, and an elliptical cylinder edge 20023 is provided on the bottom edge. An elliptical cylinder 20011 for installing the positioning sleeve 2002 is provided on the cleaning pump 2001, and the elliptical hole (elliptical cylinder hole) 20024 is just set on the elliptical cylinder 20011 to tightly fix the positioning sleeve 2002 on the elliptical cylinder 20011.

Similarly, an engagement slot (not shown) matching the positioning sleeve can be provided on the limiting plate of the cleaning liquid tank, so that the outer periphery 20021 of the positioning sleeve 2002 is limited by the engagement slot, and the elliptical cylindrical edge 20023 is limited by the bottom surface of the limiting plate, thereby fixing and limiting the cleaning pump 20. In this way, it can also achieve the effect of vibration suppression and noise reduction.

An opening slot 20012 in the vertical direction is also set in the positioning column 20011, so that the positioning column 20011 has radial elasticity, which is convenient for the positioning sleeve 2002 to be installed on the positioning column 20024, and also convenient for the positioning sleeve 2002 to be installed in the limiting plate. In this way, the assembly is better.

An elliptical cylinder hole 20013 is also set at the center of the positioning column 20024, so that the wall thickness of the positioning column 20024 is uniform, having better molding processability and avoiding shrinkage deformation.

As shown in FIG. 12, a positioning column and a positioning sleeve of another embodiment are shown. The positioning sleeve 3002 is designed as a quadrilateral, a T-shaped hole 30022 is arranged inside the positioning sleeve, and spaced vibration-suppressing holes 30021 are arranged outside the T-shaped hole 30022. A quadrilateral edge 30023 is arranged on the bottom edge. A T-shaped column 30012 for installing the positioning sleeve 3002 is arranged on the end cover surface 30011 of the cleaning pump 3001. The T-shaped hole 30022 is just set on the T-shaped column 30012 to tightly fix the positioning sleeve 3002 on the T-shaped column 30012.

Similarly, an engagement slot (not shown) matching the positioning sleeve is provided on the limiting plate of the cleaning liquid tank, so that the outer periphery 30024 of the positioning sleeve 3002 is limited by the engagement slot, and the quadrilateral edge 30023 is limited by the bottom surface of the limiting plate, thereby fixing and limiting the cleaning pump, and also achieving the effect of vibration suppression and noise reduction.

In summary, the positioning sleeve and the positioning column can also be changed in shape and structure according to the technical concept and inventive essence of the present disclosure.

What is claimed is:

1. A cleaning system used for vehicles and capable of suppressing vibrations and reducing noise, comprising a cleaning liquid tank, a cleaning pump, an elastic positioning sleeve and an elastic sealing ring, wherein a lower portion of the cleaning liquid tank is provided with an upward liquid outlet; a limiting plate is provided on a side surface of the cleaning liquid tank, and the limiting plate is opposite the liquid outlet; an engagement slot is provided in the limiting plate; a sealing hole is provided in the center of the sealing ring, and the sealing ring is fixed to the liquid outlet; a liquid intake nozzle is arranged at one end of the cleaning pump and inserted into the sealing hole of the sealing ring, an end face of the cleaning pump abuts against a surface of the sealing ring to axially position the cleaning pump; an elastic positioning member is arranged on a top cover of the cleaning pump; a positioning hole, which corresponds to the elastic positioning member, is provided in the center of the elastic positioning sleeve, so that the elastic positioning sleeve is fixed to the clastic positioning member; a plurality of vibration suppression holes are provided at intervals in the elastic positioning sleeve on the periphery of the positioning hole; the bottom of the elastic positioning sleeve is provided with an edge; and the elastic positioning sleeve is configured to sleeve the elastic positioning member, so as to be fixed to the elastic positioning member, and the elastic positioning sleeve engages with the engagement slot in the limiting plate, so that the edge is axially limited by the bottom surface of the limiting plate, and the outer periphery of the elastic positioning sleeve engages with an engagement portion on the engagement slot, so as to fix the cleaning pump.

2. The cleaning system used for vehicles and capable of suppressing vibrations and reducing noise according to claim 1, wherein the engagement slot of the limiting plate comprises an engagement socket and a plurality of arc-shaped engagement portions that cooperate with the outer periphery of the elastic positioning sleeve, and the positioning sleeve is radially limited by the arc-shaped engagement portions.

3. The cleaning system used for vehicles and capable of suppressing vibrations and reducing noise according to claim 1, wherein a vibration-suppressing slot is provided between two adjacent engagement portions of the limiting plate, and the periphery of the vibration-suppressing slot does not contact the outer periphery of the positioning sleeve.

4. The cleaning system used for vehicles and capable of suppressing vibrations and reducing noise according to claim 1, wherein avoidance slots are respectively provided on both sides of the engagement socket.

5. The cleaning system used for vehicles and capable of suppressing vibrations and reducing noise according to claim 1, wherein an axial opening slot is provided in the elastic positioning member.

6. The cleaning system used for vehicles and capable of suppressing vibrations and reducing noise according to claim 1, wherein the elastic positioning member is provided with a cylindrical hole at its center.

7. The cleaning system used for vehicles and capable of suppressing vibrations and reducing noise according to claim 1, wherein the elastic positioning member is cylindrical, and the elastic positioning sleeve is cylindrical.

8. The cleaning system used for vehicles and capable of suppressing vibrations and reducing noise according to claim 1, wherein a first vibration-suppressing hollow ring is arranged on the outer periphery of the sealing hole at a lower end of the elastic sealing ring.

9. The cleaning system used for vehicles and capable of suppressing vibrations and reducing noise according to claim 1, wherein a second vibration-suppressing hollow ring is arranged on the outer periphery of the sealing hole at a fixing surface of the elastic sealing ring, and a plurality of vibration-suppressing strips are arranged in the second vibration-suppressing hollow ring.

10. The cleaning system used for vehicles and capable of suppressing vibrations and reducing noise according to claim 1, wherein the elastic sealing ring is provided with an annular groove, and the annular groove is buckled into the edge of the liquid outlet for fixing.

* * * * *